US009815660B2

(12) United States Patent
Eddowes et al.

(10) Patent No.: US 9,815,660 B2
(45) Date of Patent: Nov. 14, 2017

(54) ROOF BOLTING CABLE BOLT FEEDING DEVICE

(71) Applicant: Joy MM Delaware, Inc., Wilmington, DE (US)

(72) Inventors: Will Eddowes, Bowral (AU); Brant Wright, Narellan Vale (AU); Michael Georgiou, Moss Vale (AU)

(73) Assignee: Joy MM Delaware, Inc., Wilmington, DE (US)

( * ) Notice: Subject to any disclaimer, the term of this patent is extended or adjusted under 35 U.S.C. 154(b) by 603 days.

(21) Appl. No.: 14/270,511

(22) Filed: May 6, 2014

(65) Prior Publication Data

US 2014/0238715 A1 Aug. 28, 2014

Related U.S. Application Data

(63) Continuation of application No. 12/762,682, filed on Apr. 19, 2010, now Pat. No. 8,727,669.

(30) Foreign Application Priority Data

Apr. 20, 2009 (AU) ..... 2009201533

(51) Int. Cl.

| | |
|---|---|
| ***E21D 20/00*** | (2006.01) |
| ***B65H 51/10*** | (2006.01) |
| ***B65H 51/32*** | (2006.01) |

(52) U.S. Cl.

CPC ..... *B65H 51/10* (2013.01); *E21D 20/003* (2013.01)

(58) Field of Classification Search

CPC ... E21D 20/003; E21D 21/006; B66D 1/7415; B66D 1/12; B66D 1/22; B66D 3/006

See application file for complete search history.

(56) References Cited

U.S. PATENT DOCUMENTS

| | | | |
|---|---|---|---|
| 1,939,320 | A | 12/1933 | Rupple |
| 2,938,707 | A | 5/1960 | Allenbaugh |
| 3,305,151 | A | 2/1967 | Cryderman |

(Continued)

FOREIGN PATENT DOCUMENTS

| | | | |
|---|---|---|---|
| AU | 642734 | B2 | 10/1993 |
| AU | 2010200388 | A1 | 8/2010 |

(Continued)

OTHER PUBLICATIONS

Chinese Office Action for Chinese Application No. 201010163785.6 dated Oct. 23, 2013 (17 pages, with English translation).

(Continued)

*Primary Examiner* — Tara M. Pinnock

(74) *Attorney, Agent, or Firm* — Michael Best & Friedrich LLP

(57) ABSTRACT

A drilling rig includes a base and a rotation unit for drilling a hole in a mine surface. The rotation unit is moveably coupled to the base. The drilling rig further includes a cable feed device for feeding a cable bolt into the hole created by the rotation unit. The cable feed device is moveably coupled to the base and includes a pair of wheels and a transmission. The cable bolt is received between the pair of wheels. The transmission is coupled between the rotation unit and at least one of the wheels to transmit power from the rotation unit to at least one of the wheels.

20 Claims, 5 Drawing Sheets

(56) References Cited

U.S. PATENT DOCUMENTS

| | | | | |
|---|---|---|---|---|
| 3,331,240 | A | 7/1967 | Nilsson et al. | |
| 4,079,592 | A | 3/1978 | Eakin | |
| 4,289,427 | A | 9/1981 | Rolston | |
| 4,504,175 | A | 3/1985 | Zion | |
| 4,514,111 | A | 4/1985 | Issakainen | |
| 4,557,465 | A * | 12/1985 | Lundberg | B66D 1/12 254/287 |
| 4,589,803 | A | 5/1986 | Totten, III | |
| 4,710,065 | A | 12/1987 | Leppanen | |
| 4,728,219 | A | 3/1988 | Leppanen | |
| 4,832,536 | A | 5/1989 | Spross et al. | |
| 5,010,834 | A | 4/1991 | Iimuro et al. | |
| 5,419,660 | A | 5/1995 | Marquis | |
| 6,030,151 | A | 2/2000 | Woolnough et al. | |
| 6,168,062 | B1 | 1/2001 | Varner et al. | |
| 6,302,623 | B1 | 10/2001 | Nellson | |
| 6,863,476 | B2 | 3/2005 | Malkoski | |
| 8,727,669 | B2 | 5/2014 | Eddowes et al. | |
| 2002/0145029 | A1 | 10/2002 | Konen et al. | |
| 2003/0066665 | A1 | 4/2003 | Coombs et al. | |
| 2003/0098007 | A1 | 5/2003 | Tabuchi et al. | |
| 2004/0118578 | A1 | 6/2004 | O'Meley | |
| 2007/0286707 | A1 | 12/2007 | Eddowes et al. | |

FOREIGN PATENT DOCUMENTS

| | | | |
|---|---|---|---|
| CN | 1928317 | A | 3/2007 |
| CN | 201011296 | Y | 1/2008 |
| DE | 3410100 | A1 | 10/1984 |
| JP | 2006083654 | A | 3/2006 |
| WO | 9851904 | | 11/1998 |

OTHER PUBLICATIONS

Australian Patent Examination Report for Australian Application No. 2009201533 dated Apr. 17, 2014 (4 pages).

First Examination Report from the Australian Patent Office for Application No. 2015202232 dated Oct. 5, 2016 (7 pages).

2nd Office Action with English translation from the State Intellectual Property Office of the People's Republic of China for Application No. 201510493066.3 dated Jul. 18, 2017 (11 pages).

* cited by examiner

ARMS IN CLOSED POSITION

ARMS IN OPEN POSITION

ROOF BOLTING CABLE BOLT FEEDING DEVICE

CROSS-REFERENCE TO RELATED APPLICATIONS

This application is a continuation application of U.S. patent application Ser. No. 12/762,682, filed on Apr. 19, 2010, which claims priority to Australian Patent Application No. AU2009201533, filed on Apr. 20, 2009, the entire contents of both applications are incorporated herein by reference.

BACKGROUND

The disclosure relates to an apparatus for reinforcing rock with a cable bolt, also called a tendon. More particularly, the disclosure relates to an apparatus for inserting the tendon into the rock.

The reinforcement of rock originally involved the use of passive support systems that utilized timber and steel structural supports. Active support systems were subsequently developed including the provision of relatively rigid roof bolts that have been widely used and still find application. Early roof bolts were provided with mechanically operated wedge devices to facilitate anchorage of the roof bolts in the relevant rock. Later, concrete grout and chemical anchoring materials were developed for anchorage of roof bolts. Most recently, flexible wire tendons or cable bolts have found widespread application and are commonly used with such anchoring materials. The cable bolts usually have spaced apart cage sections along their length where the plurality of wires that make up the cable bolt are spread apart to assist in permitting the anchoring material to grasp the cable bolt.

To install such a wire tendon, the bore for receipt of the tendon is first drilled into the rock to be supported. Given the length of the tendon, it is common to use a number of drill rod extensions to obtain the required bore depth. The selected anchoring material is then inserted in the bore and the wire tendon manually or mechanically driven into the bore prior to being tensioned to thereby support the rock once it has been anchored in position by the anchoring material.

The anchoring material is typically contained in a cartridge that facilitates its insertion into the drilled bore. The material exists in the cartridges as separate adhesive and catalyst components that are mixed together by the tendon, when inserted in the bore, to cause the anchoring material to set and so anchor the tendon in position.

A cable bolt can be up to 10 meters long and weigh up to 32 kilograms. Currently an operator has to feed the cable bolt by hand. It has been highlighted by mine managers that this is a significant health and safety concern due to the difficulty and regularity of the process, and can lead to a possible injury. Also, there is a possibility for the cable bolt to fall on the operator as it is being fed into the drilled hole.

Below is a typical cable bolting procedure.

1. Drill:

Insert a first drill steel component (with cutter at top) into square chuck in rotation unit of a drill rig, drill up (with washer plate used for aligning), and clamp when at full travel, retract drill unit and load extension drill segment, spin and feed (ensuring that the threads engage). Continue process until all needed segments are used and then remove drill segments with same procedure in reverse.

2. Load Chemicals:

Slide a one-way catch device over a first chemical sausage. Push chemical up hole with a flexible plastic rod (pusher) to the top of the hole. Load a second chemical with catch device up to meet the first at the top of the hole. And then continue until the drilled hole is filled.

3. Load Cable bolt:

Manually push cable bolt up hole by hand and then load the free end into the drill rig rotation unit.

4. Mix Chemical:

Feed the cable bolt up and then spin, stopping the feed when the cable bolt reaches the top of the hole, but continue to spin for 10 seconds or so to mix chemicals.

5. Tension Cable bolt:

Retract the stab-jack. Insert a tension collar and grout pipes through washer plate. Lift tensioner and attach to end of cable bolt.

Activate tensioner.

6. Grout at a later time.

SUMMARY

In one embodiment, the invention provides a drilling rig includes a base and a rotation unit for drilling a hole in a mine surface. The rotation unit is moveably coupled to the base. The drilling rig further includes a cable feed device for feeding a cable bolt into the hole created by the rotation unit. The cable feed device is moveably coupled to the base and includes a pair of wheels and a transmission. The cable bolt is received between the pair of wheels. The transmission is coupled between the rotation unit and at least one of the wheels to transmit power from the rotation unit to at least one of the wheels.

In another embodiment the invention provides a drilling rig including a base and rotation unit for drilling a hole in a mine surface. The rotation unit is moveably coupled to the base. The drilling rig further includes a cable feed device that has a housing removably and slidably coupled to the base for feeding a cable bolt into the hole created by the rotation unit. The housing is removably coupled to the rig rotation unit and is movable with the rig rotation unit to position the cable bolt adjacent the hole. A transmission unit is coupled between the rotation unit and the cable feed device and the rotation unit. The transmission unit is configured to feed the cable bolt through the housing to the hole.

Disclosed is a cable bolt lifting and feeding device to be used with a drill rig including a base, and a drill rig rotation unit translatable along the drill rig base. The lifting and feeding device includes a housing, a pair of spaced apart wheels, adapted to engage a cable bolt, and mounted within the housing, and wheel rotating means connected to the wheels for rotating the wheels, and adapted to be connected to the drill rig rotation unit.

Also disclosed is a device for grasping a cable bolt, the device being adapted to be attached to a drill rig rotation unit, and movable with the drill rig rotation unit to position the cable bolt adjacent a pre-drilled hole in a roof or rib. The device includes means for grasping a cable bolt having an enlarged section, and means for permitting the enlarged section to pass through the device, and for automatically holding the cable bolt in the device after feeding the cable bolt into the device.

More particularly, the means for grasping a cable bolt comprises a pair of spaced apart wheels, adapted to engage the cable bolt, and mounted within the housing, and wheel rotating means connected to the wheels for rotating the wheels, and adapted to be connected to the drill rig rotation unit.

This disclosure provides a device to help reduce the health risks involved with manually inserting a cable bolt, and to provide an efficient and sustainable aid to the cable bolting process.

An object of this disclosure is to provide such a device that is lightweight and that can be used with an existing drill rig.

Another object of this disclosure is to provide such a device that can take advantage of the power already supplied to the drill rig, by taking advantage of the available drill rotation unit. Other aspects of the invention will become apparent by consideration of the detailed description and accompanying drawings.

BRIEF DESCRIPTION OF THE DRAWINGS

In FIG. 5, a pair of pivotally connected wheel arms is shown in a closed position.

In FIG. 6, the pair of pivotally connected wheel arms is shown in an open position.

DETAILED DESCRIPTION

Figure 1:
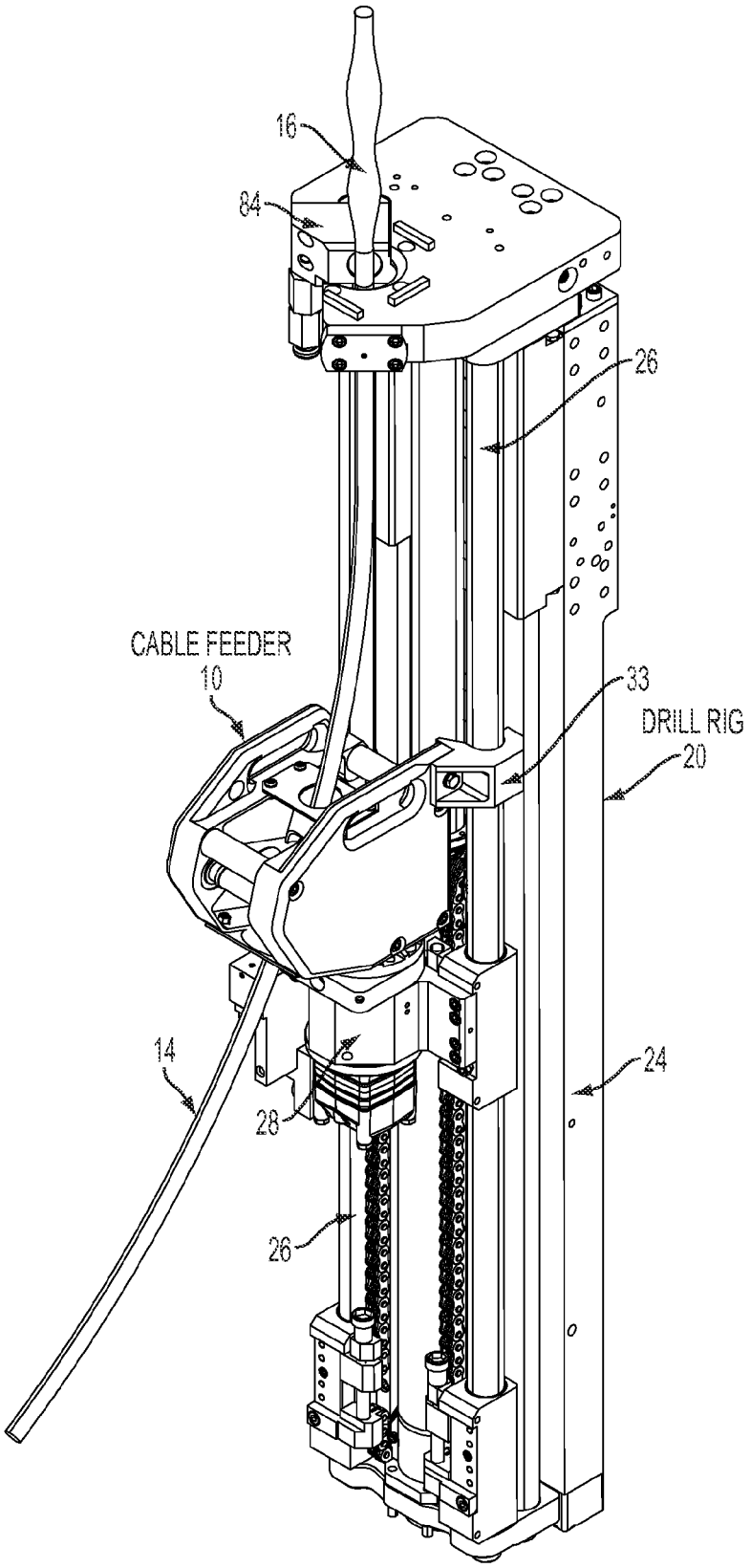
FIG. 1 is an isometric view of a drill rig including a cable bolt lifting and feeding device.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

As illustrated in the drawings, a lifting and feeding device 10 is disclosed that assists a cable bolt-bolting operator (not shown) in raising and feeding a cable bolt 14 from ground level into a pre-drilled hole (not shown) in the roof or rib. The disclosed device improves step 3 above—Load Cable bolt. Although usable with a cable bolt without cage sections, the device 10 can accommodate the cable bolt 14 with cage sections 16.

Figure 2:
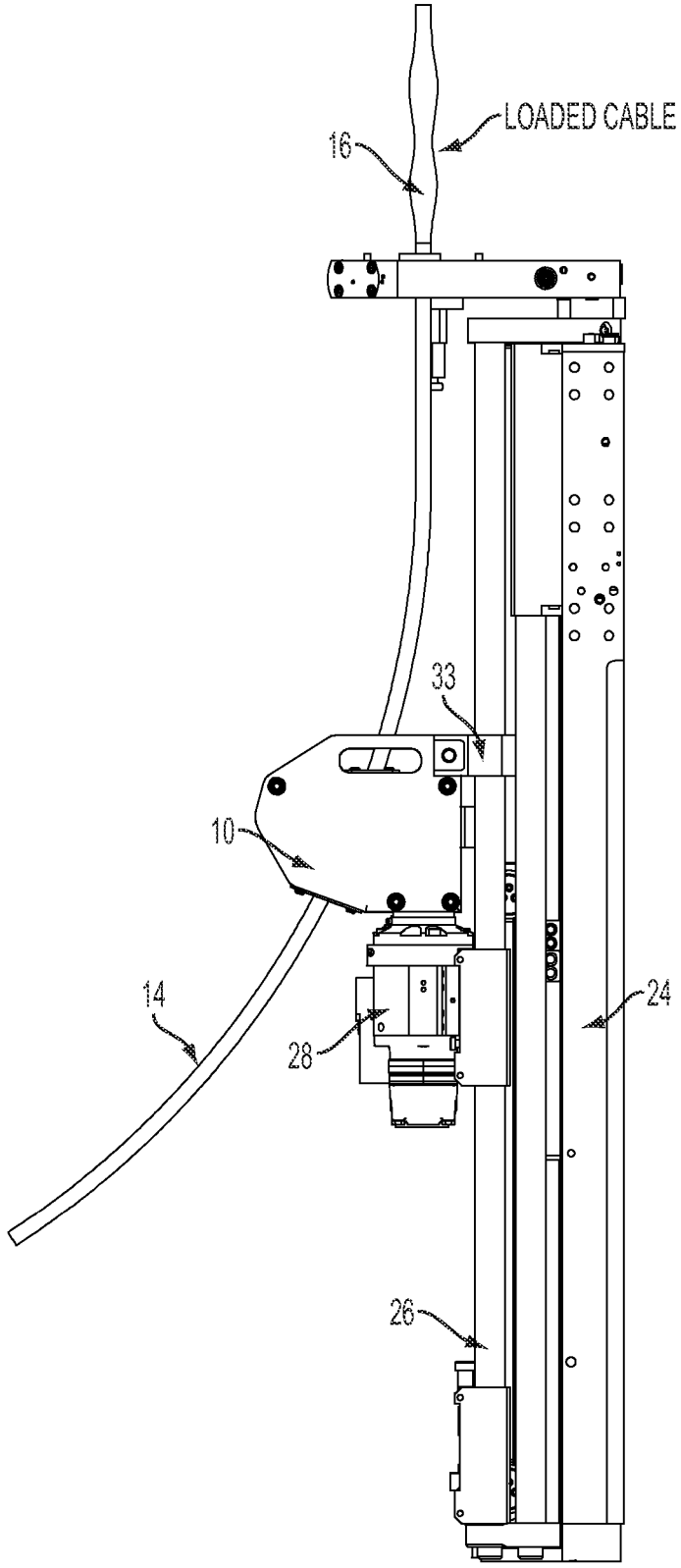
FIG. 2 is a side view of the device shown in FIG. 1.

As shown in FIGS. 1 and 2, the lifting and feeding device 10 is used with a drill rig 20 including a base 24, and a drill rig rotation unit 28 translatable along the drill rig base 24.

More particularly, the drill rig base 24 includes two spaced apart parallel feed rods 26 that extend from one end of the drill rig 20 to the other. The drill rig rotation unit 28 is translatable along the drill rig 20 by sliding along the parallel feed rods 26. Means (not shown) is also provided for moving the rotation unit 28 along the feed rods 26. In other less preferred embodiments (not shown), the device 10 can sit on the drill rotation unit 28 without being attached to the feed rods 26.

As illustrated in FIGS. 1 and 2, the lifting and feeding device 10 grasps the cable bolt 14, and is movable with the drill rig rotation unit 28 to position the cable bolt 14 adjacent a pre-drilled hole (not shown).

As illustrated in FIGS. 3 through 7, the lifting and feeding device 10 includes a housing 40, and grasping means 44 for grasping the cable bolt 14. The grasping means 44 (see FIGS. 5 and 6) is in the form of a pair of spaced apart wheels 45 and 46 mounted within the housing 40. The wheel 45 and 46 are adapted to engage or grasp the cable bolt 14. The grasping means 44 also permits, as further explained below, for the cable bolt cage section 16 to pass through the device 10. The grasping means 44 also automatically holds the cable bolt 14 in the device 10, as further explained below, after feeding the cable bolt 14 into the device 10.

Figure 5:
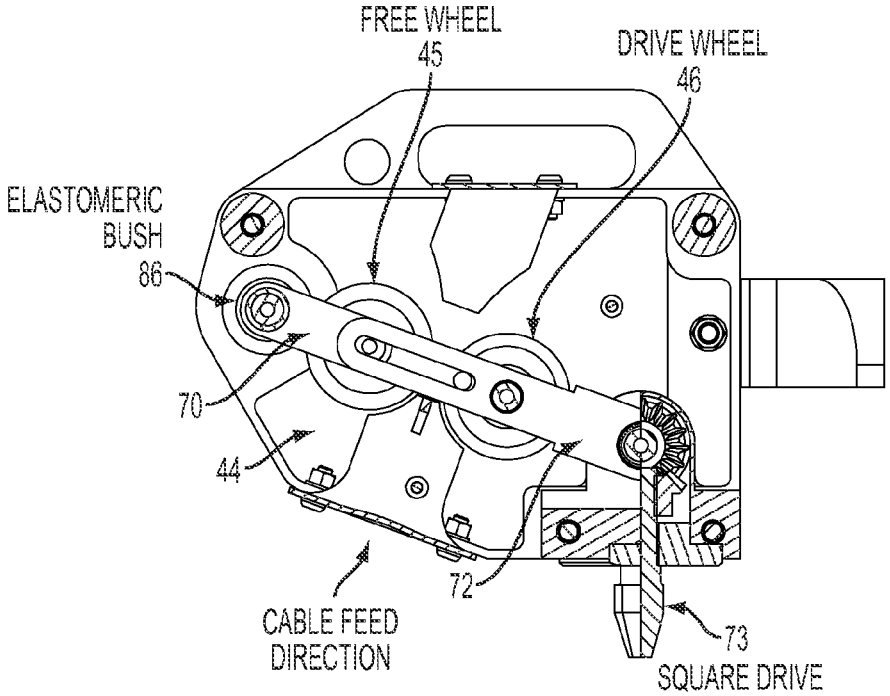
FIG. 5 is a partial cross-sectional view of the device shown in FIG. 4 taken along the line 5-5 in FIG. 4.
Figure 6:
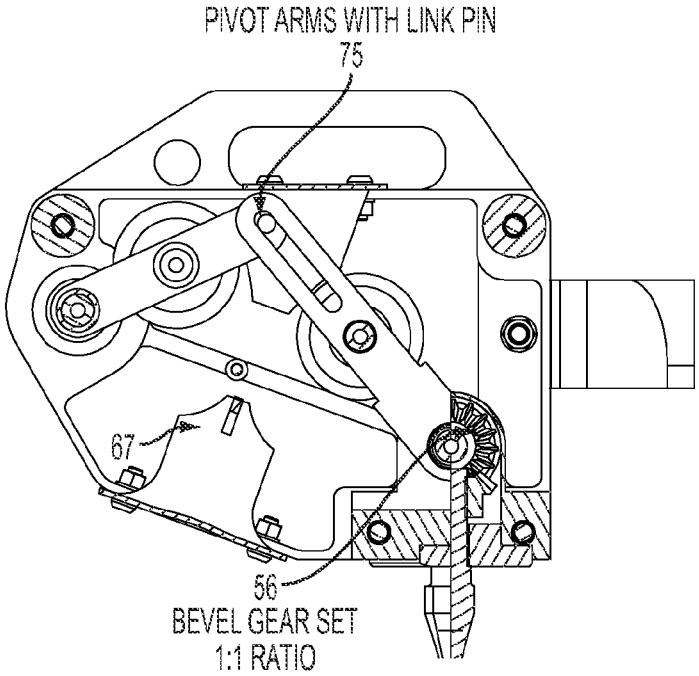
FIG. 6 is a partial cross-sectional view of the device shown in FIG. 4 taken along the line 5-5 in FIG. 4.
Figure 7:
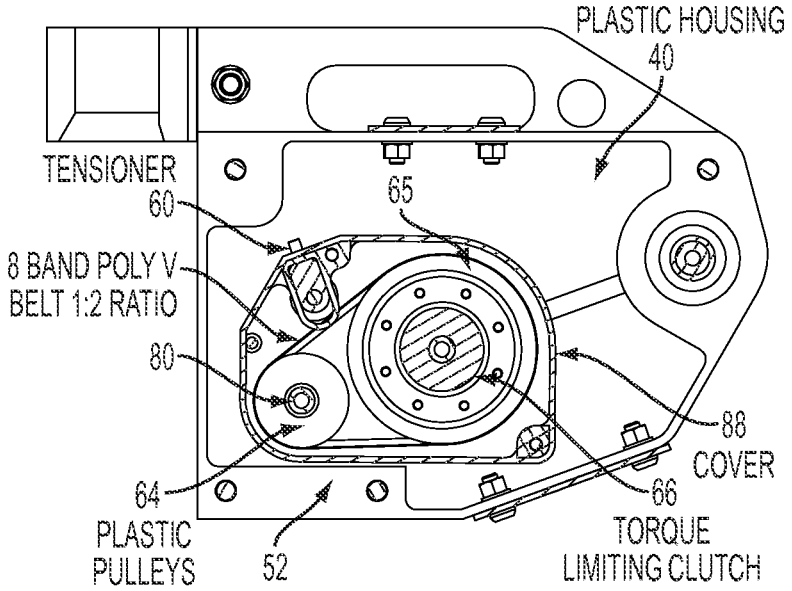
FIG. 7 is a partial cross-sectional view of the device shown in FIG. 4 taken along the line 7-7 in FIG. 4.

More particularly, the wheels 45 and 46 are each connected to the housing by a respective pivoting arm 70 and 72, respectively. Wheel rotating or drive means 48 is connected to the right-most wheel 46, as shown in the drawings, for rotating the drive wheel 46. The wheel rotating means 48 is connected to the drill rig rotation unit 28 via a belt drive 52 as shown in FIG. 7, including a bevel gear set 56 (see FIG. 5), a poly-V belt 60, and pulleys 64 and 65, all connected to a drive housing 88 that pivots relative to the housing 40. The belt drive 52 rotates the wheel 46, as shown in FIGS. 5 and 6, in a clockwise direction, and prohibits rotation of the drive wheel 46 in the reverse direction. A torque limiting friction clutch 66 is used on the large pulley 65. The two wheels draw closer as they lower, as shown in FIG. 5, until they reach a stop 67.

In other embodiments, transmitting power from the rotation unit 28 to the wheels 45 and 46 can be achieved in a number of ways. This device 10 uses the bevel gear set and the poly-V belt and the pulley design. This combination was selected due to weight, size and speed reduction requirements. Plastic was used wherever possible to reduce the weight of the device.

The wheels are mounted to the two separate pivoting arms 70 and 72. This enables the larger diameter (approx 45 mm) cage sections to be pushed through the feed tube formed by the spaced apart wheels 45 and 46 (50 mm inside diameter) when inserting the cable bolt 14.

The lifting and feeding device 10 is adapted to be connected to the housing 40 and slidably along the drill base 24 for translatable movement along the drill base 24 with the drill rig rotation unit 28. More particularly, as shown in FIGS. 1 and 2, the device 10 sits atop of the rotating unit 28, and the device 10 moves with the rotation unit 28. The device 10 includes two locating brackets 33 that are secured around the pair of spaced apart parallel feed rods 26 in the form of steel bars that form part of the base 24. As a result of the locating brackets 33 having notches 34 that grasp the outside of the feed rods 26, as shown in FIG. 1, the device can readily slide along the feed rods 26 and move with the rotational unit 28 up and down the drill rig 20.

Figure 3:
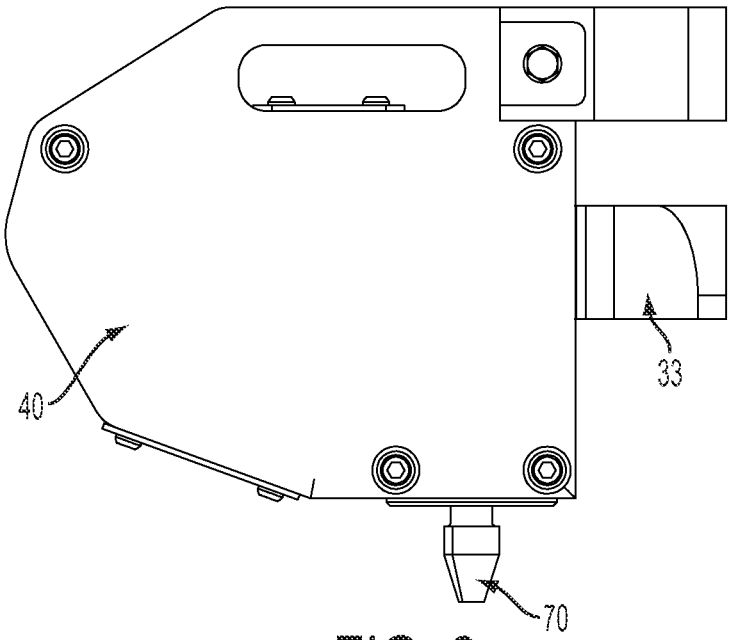
FIG. 3 is a side view of the cable bolt lifting and feeding device shown in FIG. 1.
Figure 4:
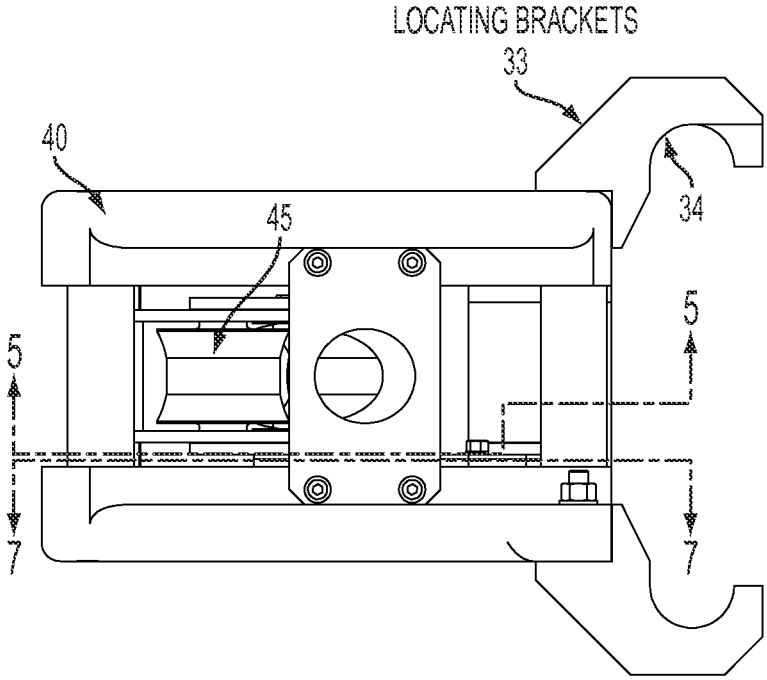
FIG. 4 is a top view of the device shown in FIG. 3.

As illustrated in FIGS. 3, 5 and 6, a square drive 73 fits into a mating opening (not shown) in the top of the rotating unit 28. The square drive 73 rotates; turning the bevel gear set 56. The bevel gear set 56, in turn, drives the first plastic pulley 64, as shown in FIG. 7, which, in turn, drives the V belt 60, which, in turn, drives the large pulley 65, and the torque-limiting clutch 66. The torque-limiting clutch 66 in turn is drivingly connected to the drive wheel 46.

As shown in FIGS. 5 and 6, and mentioned earlier, the wheels 45 and 46 are mounted on the pivoting arms 70 and 72. The arms 70 and 72 are connected to one another by a link pin 75. When a cable 14 is fed between the wheels 45 and 46, if the cable 14 is larger than the spacing between the wheels 45 and 46, then the arms 70 and 72 will pivot away from the cable 14, increasing the spacing between the wheels 45 and 46. This allows a cage section 16 to readily pass between the wheels 45 and 46 when spaced apart, as shown in FIG. 6. When the cable is released it will tend to fall due to gravity and with any such retractive motion the arms will pivot down resulting in the grasping of the cable 14. This grasping force increases as the retractive force increases (ie. as it lifts more weight or if someone pulls on the cable) preventing any slippage. The drive wheel will not rotate because the drive system is engaged with the drill. Therefore the only movement of the cable in either the upward or downward directions is in a controlled manner via the drill controls.

In order to permit the pivoting of the rightmost arm 72, the belt drive 52 pivots with the arm 72, for the belt drive 52 is pivotally mounted to the housing 40 at the first pulley 64 by a pin 80, so that the belt drive can pivot about the bevel gear set 56.

In summary, the device is a lightweight unit that mounts into the drill rig rotation unit. It uses the mechanical power provided in the rotation unit to drive the set of wheels that engage with the cable bolt, causing the cable bolt to be pushed through the device and into the pre-drilled hole.

Procedure (at Stage 3 of the cable bolting procedure in the background):

1. loading device onto drill rig:

The device 10 is located by a drive shaft in the rotation unit 28, and the two brackets 33 that slide on the feed rods 26, thus becoming an extension of the rotation unit and able to move up and down the drill rig 20. To place the device in position, the brackets must be engaged first by rotating the device 10 (approximately 30 degrees) and hooking the brackets 33 around the back of the feed rods 26. After straightening the device 10 up, the brackets are engaged and the device can be lowered into the rotation unit chuck.

2. position device:

Next the device (with the rotation unit) needs to be positioned at an appropriate height on the feed to align the pre-drilled hole with the outlet hole of the device. This is done by operating the drill rig and raising the rotation unit.

3. preload cable bolt:

Most cable bolts have a number of cage sections at the top end of the cable bolt for improved performance. The cable bolt must be fed through the device and up into the hole until the last cage section passes out the end of the device. The cable bolt can then be released where the automatic detent system holds the cable bolt in position.

4. feed cable bolt into hole:

Once loaded, the cable bolt can be fed by operating the rotate function of the drill rig.

This will spin the wheels and drive the cable bolt into the pre-drilled hole.

5. retract device and remove:

Using clamping jaws 84 incorporated in the drill rig top plate, the cable bolt 14 is clamped and held while the device (with rotation unit) is retracted. This leaves a cable bolt end hanging from the hole. Once retracted, the feed device can be removed by a reverse of step 1, (possibly a brief reverse spin of the rotation unit is required first to disengage the drive shaft).

6. load cable bolt end into rotation unit:

By operating the drill rig and raising the rotation unit the suspended cable bolt end is engaged into the chuck.

In addition to the pivoting arms allowing a size variation in the cable bolt 14 to be pushed through, the sprag motion is utilized to auto detent the cable bolt from dropping. The sprag motion (where the two wheel arcs draw closer as they lower until they reach the stop 67) increases the force applied to the cable bolt exponentially until it jams. To limit this jamming force from becoming self-destructive, an elastomeric bushing 86 (or any other type of spring) is used at the end of the pivot arm 70. This force will be applied to the cable bolt when the device is both driven and stopped. To retract the cable bolt the rotation unit must be operated in reverse, which causes the pivot arms to rise and reduce the load on the cable bolt.

The second arm is connected to the first via a pin that ensures that the two wheels rise and fall approximately together. This prevents any offsetting of the wheels and ensures that the loading is in approximately the same direction on the wheels as they rise and fall. This angle is approximately perpendicular to the cable bolt.

The torque limiting friction clutch 66 is used on the large pulley 65 to ensure that high torque loads are not transferred to any of the transmission elements. This high torque is produced if the wheels clamp too hard on the cable bolt 14 when the elastomeric bushing 86 reaches maximum deflection.

It will be understood that the invention disclosed and defined herein extends to all alternative combinations of two or more of the individual features mentioned or evident from the text. All of these different combinations constitute various alternative aspects of the invention.

Various features and advantages of the invention will be apparent in the following claims.

What is claimed is:

1. A drill rig comprising:

a base defining a base axis;

a rotation unit for providing rotational power, the rotation unit movably coupled to the base;

a housing detachably coupled to the base and movable relative to the base in a direction parallel to the base axis;

a first arm pivotably coupled to the housing;

a second arm pivotably coupled to the housing, the second arm and the first arm engaging one another such that pivotal movement of one of the first arm and the second arm causes pivotal movement of the other of the first arm and the second arm;

a pair of wheels supported for rotation relative to the housing, the pair of wheels including a first wheel coupled to the first arm and a second wheel coupled to the second arm, the first wheel and the second wheel being rotatable in a plane and adapted to drive a cable along a feed direction parallel to the plane, wherein pivoting movement of the first arm and second arm causes the wheels to translate in the plane; and a transmission for transmitting power from the rotation unit to at least one of the first wheel and the second wheel.

2. The drill rig of claim 1, wherein the transmission includes a first gear driven by the rotation unit and a second gear engaging the first gear, wherein the second gear is coupled to one of the first wheel and the second wheel and rotation of the second gear causes the one of the first wheel and the second wheel to rotate.

3. The drill rig of claim 2, wherein the transmission includes a first pulley coupled to the second gear, a second pulley coupled to the one of the first wheel and the second wheel, and a poly v-belt wrapped around the first pulley and the second pulley.

4. The drill rig of claim 3, wherein the transmission includes a clutch positioned between the first pulley and the one of the first wheel and the second wheel.

5. The drill rig of claim 1, wherein the base includes at least one feed rod extending parallel to the base axis, and wherein the housing includes at least one bracket engaging the at least one feed rod.

6. The drill rig of claim 5, wherein the base includes a pair of feed rods, and wherein the housing includes a pair of brackets, the brackets offset relative to one another along the base axis.

7. The drill rig of claim 1, wherein moving the first arm in a first direction relative to the housing causes the first wheel to move away from the second wheel, and moving the first arm in a second direction opposite the first direction causes the first wheel to move toward the second wheel.

8. The drill rig of claim 1, wherein the pair of wheels are configured to receive a cable between the wheels, the cable curving from a substantially horizontal direction to a substantially vertical direction.

9. The drill rig of claim 8, wherein the pair of wheels move toward one another when the cable is pulled in a direction opposite the feed direction.

10. The drill rig of claim 1, wherein the housing and the rotation unit move together relative to the base.

11. A drill rig comprising:

at least one rod extending parallel to a base axis;

a rotation unit for providing rotational power, the rotation unit supported for movement relative to the rod parallel to the base axis; and a cable feed device including a housing removably coupled to the rod and movable relative to the rod parallel to the base axis, a first wheel supported for rotation on the housing and configured to drive a cable in a feed direction, the first wheel supported on a first arm pivotably coupled to the housing, a second wheel spaced apart from the first wheel and supported for rotation on the housing, the second wheel configured to drive the cable in the feed direction, the second wheel supported on a second arm pivotably coupled to the housing, the second arm engaging the first arm such that pivotal movement of one of the first arm and the second arm causes pivotal movement of the other of the first arm and the second arm, and a transmission unit detachably coupled to the rotation unit and transmitting power from the rotation unit to the first wheel, wherein pivotal movement of the first arm and the second arm causes the first wheel and the second wheel to translate in a plane parallel to the feed direction.

12. The drill rig of claim 11, wherein moving the first arm in a first direction relative to the housing causes the first wheel to move away from the second wheel, and moving the first arm in a second direction opposite the first direction causes the first wheel to move toward the second wheel.

13. The drill rig of claim 11, wherein the transmission unit includes a first pulley driven by the rotation unit, a second pulley coupled to one of the first wheel and the second wheel, and a belt wrapped around the first pulley and the second pulley.

14. The drill rig of claim 11, wherein the cable feed device includes a clutch positioned between the transmission unit and the first wheel.

15. The drill rig of claim 11, wherein the housing includes a pair of brackets for detachably engaging the rod, wherein the brackets are offset from one another in a direction parallel to the base axis.

16. A drill rig comprising:

a pair of parallel rods oriented parallel to a base axis;

a rotation unit for providing rotational power, the rotation unit supported for movement relative to the rods along the base axis;

a housing slidable relative to the rods along the base axis, the housing including a first arm pivotably coupled to the housing and a second arm pivotably coupled to the housing, the first arm and the second arm engaging one another, the housing including a pair of brackets, each bracket detachably engaging one of the rods, the brackets offset from one another in a direction parallel to the base axis;

a first wheel supported on the first arm and rotatable relative to the housing;

a second wheel spaced apart from the first wheel and supported on the second arm, the second wheel rotatable relative to the housing;

a transmission unit including a gear drive transmitting power from the rotation unit to the first wheel.

17. The drill rig of claim 16, wherein the first wheel and the second wheel are configured to drive the cable in a feed direction.

18. The drill rig of claim 16, wherein pivotal movement of the first arm and the second arm causes the first wheel and the second wheel to translate in a plane parallel to the feed direction.

19. The drill rig of claim 16, wherein the second arm engages the first arm such that pivotal movement of one of the first arm and the second arm causes pivotal movement of the other of the first arm and the second arm.

20. The drill rig of claim 19, wherein the one of the first arm and the second arm includes a pin and the other of the first arm and the second arm includes a slot receiving the pin, the pin being slidable within the slot.

* * * * *